United States Patent [19]

Staley, III et al.

[11] Patent Number: 4,620,681

[45] Date of Patent: Nov. 4, 1986

[54] APPARATUS FOR RECEIVING EMPTY BEVERAGE CANS

[76] Inventors: Ellis J. Staley, III, 305 Parkview Dr., Schenectady, N.Y. 12303; John G. Walsh, III, 291 Woodlawn Ave., Albany, N.Y. 12208

[21] Appl. No.: 571,783

[22] Filed: Jan. 18, 1984

[51] Int. Cl.[4] ..... B65B 67/12

[52] U.S. Cl. ..... 248/95; 248/99

[58] Field of Search ..... 248/95, 99, 100, 101, 248/DIG. 7, 295.1, 497, 225.1; 206/428, 427; 220/404

[56] References Cited

U.S. PATENT DOCUMENTS

| | | | |
|---|---|---|---|
| 1,052,379 | 2/1913 | Ranken | 220/404 |
| 2,641,427 | 6/1953 | Krogh | 248/497 |
| 3,180,384 | 4/1965 | Seifert | 248/95 |
| 3,737,129 | 6/1973 | Foster | 248/97 |
| 3,784,049 | 1/1974 | Hawk | 248/95 |
| 3,788,720 | 1/1974 | Schneider | 248/99 |
| 3,836,037 | 9/1974 | Bass | 220/35 |
| 3,977,450 | 8/1976 | Schampier | 248/95 |
| 4,027,774 | 6/1977 | Cote | 220/63 |
| 4,062,170 | 12/1977 | Orem | 53/390 |
| 4,069,993 | 1/1978 | Shanks | 248/97 |
| 4,099,616 | 7/1978 | Klygis | 206/427 |
| 4,133,509 | 1/1979 | Kalbow et al. | 248/225.1 |
| 4,290,525 | 9/1981 | Sisson | 206/427 |
| 4,299,324 | 11/1981 | Dickens | 206/170 |
| 4,338,979 | 7/1982 | Dow | 248/101 |

FOREIGN PATENT DOCUMENTS

| | | | |
|---|---|---|---|
| 0463167 | 4/1951 | Italy | 248/497 |

*Primary Examiner*—Ramon O. Ramirez

*Attorney, Agent, or Firm*—Heslin & Rothenberg

[57] ABSTRACT

An improved apparatus for receiving empty beverage cans is disclosed in which a bag (42, 44) has a plurality of closure bands (48) positioned about the periphery of its mouth (46), and an annular support member (10–18) has a plurality of corners (20) provided with downwardly curved, essentially U-shaped slits (36, 38, 40) extending through the thickness of the annular member on each side of the corners, whereby the closure bands of the bag may be drawn over the upper edge of the annular member and slipped into and upward within one of the slits to cause the ends of the slits to grip the closure bands on each side of the corners.

13 Claims, 2 Drawing Figures

APPARATUS FOR RECEIVING EMPTY BEVERAGE CANS

TECHNICAL FIELD

The present invention concerns apparatuses for receiving and transporting refuse. More particularly, the invention concerns an improved apparatus for receiving empty beverage cans at the point of their consumption and for transporting such cans to a point of disposal for recycling.

BACKGROUND ART

In recent years, a growing desire to protect the environment has led to the passage of a number of local, state and national laws and regulations intended to minimize littering of the landscape. Since beverage containers in general and metal cans in particular have long been considered a specially offensive type of litter, various localities have required than consumers pay deposits on such containers and that the containers be returned to points of purchase for refund of the deposit. Food market operators have objected to such regulations due to the difficulty of handling large volume of empty containers and consumers often have foregone their deposits due to the inconvenience of packaging the empty containers and returning them to the point of purchase.

Various attempts have been made to provide carriers for empty beverage cans on which a deposit may be refunded. For example, U.S. Pat. No. 4,290,525 granted to Sisson discloses a clear plastic carrier resembling a shopping bag having at least one transparent wall to permit inspections of the contents, the wall having indicia which provide an automatic count of number of empty cans. U.S. Pat. No. 4,299,324, granted to Dickens, discloses a foldable beverage can container also made from plastic sheet. While products such as those disclosed in these patents have achieved a certain measure of success, their use in the home would be relatively cumbersome since the mouth of the bag apparently would have to be held open with one hand and the empty cans inserted with the other.

Prior art attempts to produce devices for holding open the mouth of a refuse bag or the like are disclosed, for example, in U.S. Pat. No. 3,737,129 granted to Foster; U.S. Pat. No. 3,784,049 granted to Hawk; U.S. Pat. No. 3,836,037 granted to Bass; U.S. Pat. No. 4,027,774 granted to Cote; U.S. Pat. No. 4,062,170 granted to Orem; and U.S. Pat. No. 4,069,993 granted to Shanks. Finally, U.S. Pat. No. 4,099,616 granted to Klygis discloses a container carrier in which pairs of closure straps are tied across the mouth of the container to facilitate carrying full containers from the point of sale; however, the carrier apparently is not reusable for returning empty containers.

DISCLOSURE OF THE INVENTION

An object of the invention is to provide an improved apparatus for receiving empty beverage containers such as metal cans.

A further object of the invention is to provide such an apparatus which is simple, inexpensive and easy to use by the typical consumer.

Still another object of the invention is to provide such an apparatus in which the bag or carrier for empty cans maintains the cans in a convenient arrangement for counting and stacking at the point of disposal.

These objects of the invention are given only by way of example; therefore, other desirable objectives and advantages inherently achieved by the disclosed invention may occur or become apparent to those skilled in the art. Nonetheless, the scope of the invention is to be limited only by the appended claims.

In accordance with one embodiment of the invention, an improved device is provided for holding open the mouth of a bag of the type comprising a plurality of closure straps or bands positioned about the periphery of its mouth and for supporting the bag during filling. Such a device comprises an annular member having an interior surface and an exterior surface, means for gripping the closure bands of such a bag at spaced locations around the annular member, while the bag is supported beneath the annular member and means operatively associated with the annular member for permitting the annular member to be mounted to a separate support. In the preferred embodiment of the invention, the annular member comprises a plurality of outwardly extending corners. The means for gripping the closure band comprises at each corner a downwardly curved, essentially U-shaped slit which extends through the thickness of the annular member on each side of the corner. Enough of such slits are provided to correspond in number to the number of closure bands on the bag. As a result, each of the closure bands may be drawn over the upper edge of the annular member and slipped into and upward within one of the slits to cause the ends of the slit to grip the closure band on each side of the corner. The scope of the invention also includes the combination of such an improved device for holding open the mouth of the bag with a bag having a plurality of closure bands positioned about the periphery of its mouth.

BEST MODE FOR CARRYING OUT THE INVENTION

Figure 1:
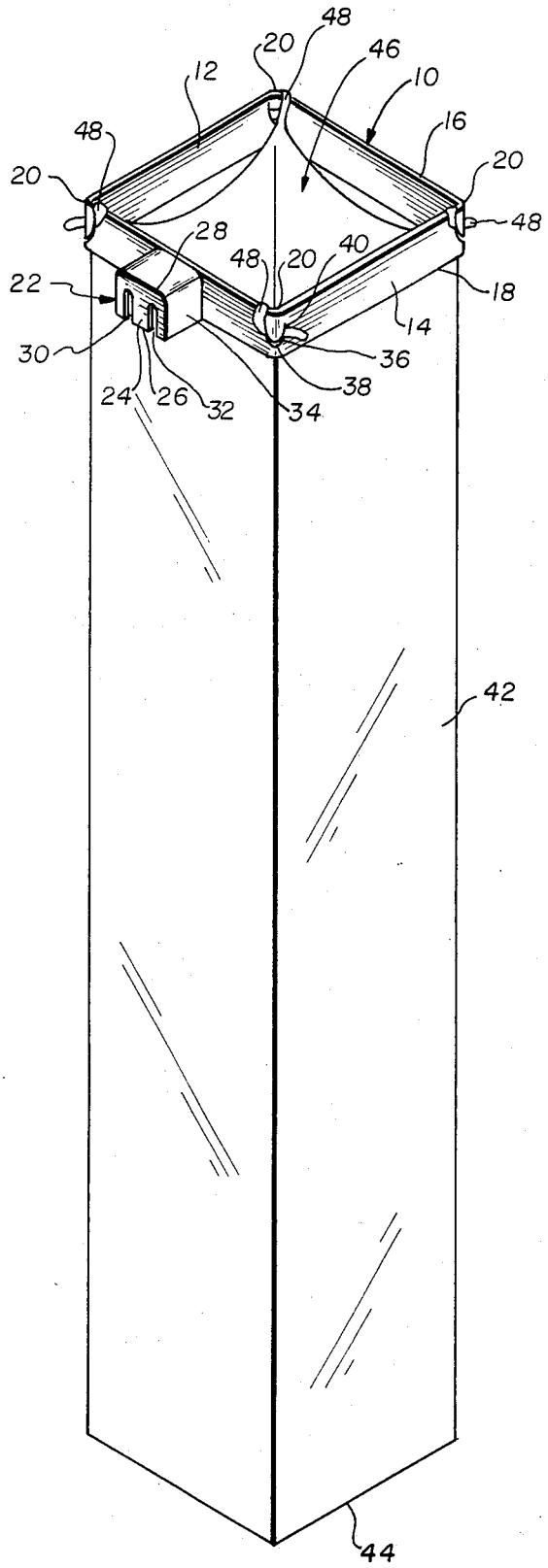
FIG. 1 shows a perspective view of the combined holding device and empty container bag according to the present invention.

The following is a detailed description of a preferred embodiment of the invention, reference being made to the drawings in which like reference numerals identify like elements of structure in each of the Figures.

Figure 2:
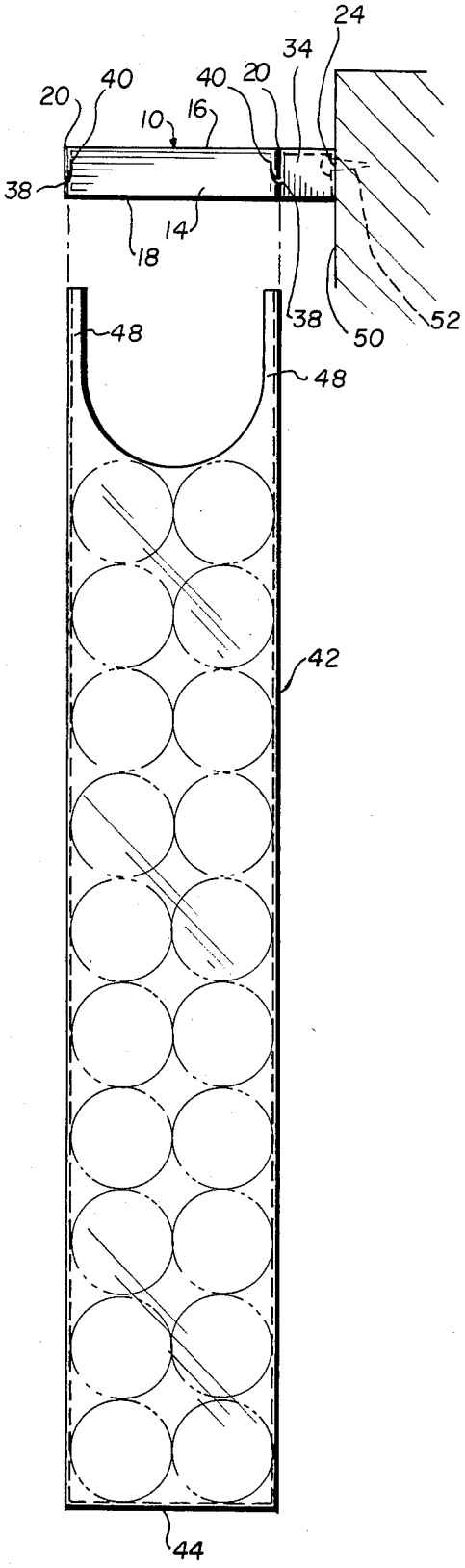
FIG. 2 shows a side elevation view of the apparatus illustrated in FIG. 1, after the bag has been filled and disconnected from the holding device.

Referring simultaneously to FIGS. 1 and 2, those skilled in the art will understand the features of an apparatus for receiving empty beverage cans in accordance with the invention. An annular, preferably rectangular member 10 has an interior surface 12 and an exterior surface 14 extending between an upper edge 16 and a lower edge 18 and preferably has four corners 20. As illustrated, it is preferred that all of corners 20 of annular member 10 extend outwardly; however, it is also within the scope of the invention to provide one or more corners which are reversed to extend inwardly. Annular member 10 preferably is closed around its entire periphery; however, an opening or gap may be provided in its wall, if desired.

Between two of corners 20 is provided a means 22 for permitting the annular member 10 to be mounted on an adjacent support. Means 22 comprises an essentially vertical support plate 24 having a lower edge 26 and an upper edge 28. At least one slot 30 and preferably a second slot 32 are provided which extend upwardly from lower edge 26 and through the thickness of support plate 24 to facilitate attachment to an adjacent support in the manner to be discussed subsequently. A U-shaped bracket 34 is formed integrally with support plate 24 for attaching support plate 24 to the exterior surface 14 of annular member 10, at a location spaced radially outwardly from exterior surface 14.

Each corner 20 of annular member 10 comprises means for gripping the closure bands of a bag for receiving empty beverage containers, while the bag is supported beneath the annular container. In accordance with the invention, this gripping means comprises a downwardly curved, essentially U-shaped slit 36 which extends through the thickness of annular member 10. Slits 36 preferably are provided at enough of the corners 20 of the annular member 10 to correspond to the number of closure bands provided on the associated bag, as will be discussed subsequently. Each slit 36 has a mouth 38 at its lower end and extends upwardly while growing progressively more narrow until a pair of tight ends 40 are reached. The combined structure of elements 10–40 may be formed from a variety of materials, including wood, metal or molded plastic.

As shown in FIGS. 1 and 2, the preferred form of bag or carrier for empty beverage cans comprises a square tubular body 42 having a cross-section adequate to receive a pair of 12 ounce beverage cans side by side, as indicated in phantom in FIG. 2. Of course, other size bags and support members may be provided for larger or smaller cans or containers, without departing from the scope of the invention. Preferably, the bag is made from a clear plastic material so that the number of cans within the bag can be observed. To facilitate determining the amount of refund due upon return of the beverage cans, the size of the bag may be selected to receive an exact number, say 20, of such cans. The flat bottom 44 of the bag may be formed by suitable gussets in the familiar manner. At the mouth 46 of the bag, a plurality, preferably four, closure bands 48 are provided.

In use of the apparatus according to the invention, annular member 10 is attached to an adjacent support surface 50 by means, for example, of screws 52, shown in phantom. Then, closure bands 48 are pulled up through annular member 10 and over upper edge 16 so that each closure band can be slipped transversely into and upwardly within one of slits 36. As a result, the tight upper ends 40 of the slits grip the closure bands on either side of each corner 20, as shown in FIG. 1.

In one actual embodiment of the invention, annular member 20 was approximately 5 inches square, 1½ inches high and one-sixteen inch thick. The bag used in the combination according to the invention was also approximately 5 inches square at its mouth and 27½ inches high to the upper ends of its closure bands which also were 5 inches long. Such a bag will accommodate 20 empty beverage cans.

Having described my invention in sufficient detail to enable those skilled in the art to make and use it, I claim:

1. An improved device for holding open the mouth of a bag of the type comprising a plurality of closure bands positioned around the periphery of its mouth and for supporting the bag during filling, said device comprising:

a substantially rigid annular member separate from the bag;

means integral with said member for gripping the closure bands of such a bag at spaced locations around said annular member while said bag is supported beneath said annular member;

means operatively associated with said annular member for permitting said annular member to be mounted to a support; and wherein said annular member comprises a plurality of corners; and said means for gripping comprises a downwardly curved essentially U-shaped slit extending through the thickness of said annular member on each side of a plurality of said corners corresponding in number to the number of closure bands of such a bag, whereby each closure band may be drawn over the upper surface of said annular member and slipped into and upward within one of said slits to cause ends of said slits to grip the closure bands on each side of said corners.

2. An improved supporting and holding device according to claim 1, wherein said means for permitting mounting comprises a support plate having a lower edge, at least one upwardly extending slot through the thickness of said support plate, said slot opening downwardly through said lower edge, and means for attaching said plate to said annular member at a position between a pair of said corners, said position being spaced outwardly from an exterior surface of said member.

3. An improved supporting and holding device according to claim 1, wherein said corners extend outwardly from said annular member.

4. An improved supporting and holding device according to claim 3, wherein said annular member is rectangular and sized to permit passage of a beverage can.

5. An improved apparatus for receiving empty beverage cans; said apparatus comprising:

a bag having a plurality of closure bands positioned around the periphery of its mouth;

a substantially rigid annular member separate from the bag;

means integral with said member for gripping said closure bands at spaced locations around said annular member while said bag is supported beneath said annular member;

means operatively associated with said annular member for permitting said annular member to be mounted on a support; and wherein said annular member comprises a plurality of corners; and said means for gripping comprises a downwardly curved, essentially U-shaped slit extending through the thickness of said annular member on each side of a plurality of said corners corresponding in number to the number of said closure bands, whereby each closure band may be drawn over the upper edge of said annular member and slipped into and upward within one of said slits to cause ends of said slits to grip said closure bands on each side of said corners.

6. An improved apparatus according to claim 5, wherein said means for permitting mounting comprises a support plate having a lower edge, at least one upwardly extending slot through the thickness of said support plate, said slot opening downwardly through said lower edge, and means for attaching said plate to said annular member at a position between a pair of said corners, said position being spaced outwardly from an exterior surface of said member.

7. An improved apparatus according to claim 5, wherein said corners extend outwardly from said annular member.

8. An improved apparatus according to claim 7, wherein said annular member is rectangular and sized to permit passage of a beverage can.

9. The improved apparatus of claim 8 wherein the mouth of the bag has a rectangular cross section and the closure bands are positioned at corners of said mouth.

10. The improved apparatus accordingly to claim 9 wherein said bag has a rectangular cross section throughout its length and a flat bottom.

11. The improved apparatus of claim 10 wherein the rectangular cross section of the bag at its mouth and throughout its length is substantially equal to the cross section of said annular member.

12. The improved apparatus of claim 11 wherein the bag is made of clear material permitting the number of cans within the bag to be readily observed therethrough.

13. The improved apparatus accordingly to claim 12 wherein said bag is further configured to hold a specified predetermined number of beverage cans when the bag is full.

* * * * *